US007468720B2

(12) United States Patent
Kim

(10) Patent No.: US 7,468,720 B2
(45) Date of Patent: Dec. 23, 2008

(54) HORIZONTAL ELECTRIC FIELD APPLYING TYPE LIQUID CRYSTAL DISPLAY DEVICE AND DRIVING METHOD THEREOF

(75) Inventor: Kyong Soek Kim, Anyang-si (KR)

(73) Assignee: LG Display Co., Ltd., Seoul (KR)

( * ) Notice: Subject to any disclaimer, the term of this patent is extended or adjusted under 35 U.S.C. 154(b) by 619 days.

(21) Appl. No.: 11/014,791

(22) Filed: Dec. 20, 2004

(65) Prior Publication Data

US 2005/0162363 A1 Jul. 28, 2005

(30) Foreign Application Priority Data

Dec. 23, 2003 (KR) ..... 10-2003-0095662

(51) Int. Cl.
*G09G 3/36* (2006.01)

(52) U.S. Cl. ..... 345/100

(58) Field of Classification Search ..... 345/92, 345/96, 87–104, 204

See application file for complete search history.

(56) References Cited

U.S. PATENT DOCUMENTS 5,854,616 A * 12/1998 Ota et al. ..... 345/100
5,877,736 A * 3/1999 Imajo et al. ..... 345/89
6,023,260 A * 2/2000 Higashi ..... 345/100
6,075,505 A * 6/2000 Shiba et al. ..... 345/87
6,262,704 B1 * 7/2001 Kurumisawa et al. ..... 345/98
6,295,142 B1 * 9/2001 Watanabe et al. ..... 358/482
6,426,594 B1 * 7/2002 Ito ..... 315/169.1
7,030,869 B2 * 4/2006 Morita ..... 345/208
7,113,159 B2 * 9/2006 Sawabe ..... 345/89
7,176,869 B2 * 2/2007 Kumada et al. ..... 345/94
2003/0089916 A1 5/2003 Matsumoto

FOREIGN PATENT DOCUMENTS

CN 1419229 A 5/2003

* cited by examiner

*Primary Examiner*—Alexander Eisen
*Assistant Examiner*—Robert E Carter, III
(74) *Attorney, Agent, or Firm*—McKenna Long & Aldridge LLP

(57) ABSTRACT

A liquid crystal display device and a fabricating method thereof for lowering power consumption and integrating a driver on a substrate are disclosed. The liquid crystal display device includes a liquid crystal display panel having TFTs provided at crossings between gate lines and data lines on a substrate and connected in a zigzag pattern based on the gate lines, pixel electrodes connected to the thin film transistors, common electrodes making a horizontal electric field with the pixel electrodes, and common lines connected to the common electrodes and arranged substantially parallel to the gate lines. A gate driver applies a scanning pulse signal to the gate lines of the liquid crystal display panel. A data driver applies pixel voltage signals to the data lines. A common driver applies alternating current common voltage signals to the common lines. The gate driver and the common driver are integrated on the substrate.

14 Claims, 19 Drawing Sheets

FIG. 3A
RELATED ART

| | | | | | | | |
|---|---|---|---|---|---|---|---|
| + | − | + | − | + | − | + | − |
| − | + | − | + | − | + | − | + |
| + | − | + | − | + | − | + | − |
| − | + | − | + | − | + | − | + |
| + | − | + | − | + | − | + | − |
| − | + | − | + | − | + | − | + |
| + | − | + | − | + | − | + | − |
| − | + | − | + | − | + | − | + |

FIG.3B
RELATED ART

| | | | | | | | |
|---|---|---|---|---|---|---|---|
| − | + | − | + | − | + | − | + |
| + | − | + | − | + | − | + | − |
| − | + | − | + | − | + | − | + |
| + | − | + | − | + | − | + | − |
| − | + | − | + | − | + | − | + |
| + | − | + | − | + | − | + | − |
| − | + | − | + | − | + | − | + |
| + | − | + | − | + | − | + | − |

HORIZONTAL ELECTRIC FIELD APPLYING TYPE LIQUID CRYSTAL DISPLAY DEVICE AND DRIVING METHOD THEREOF

This application claims the benefit of Korean Patent Application No. P2003-95662 filed in Korea on Dec. 23, 2003, which is hereby incorporated by reference for all purposes as if fully set forth herein.

BACKGROUND OF THE INVENTION

1. Field of the Invention

The present invention relates to a liquid crystal display, and more particularly to a liquid crystal display device and a fabricating method thereof for lowering power consumption as well as integrating a driver on a substrate.

2. Discussion of the Related Art

Generally, a liquid crystal display (LCD) controls light transmittance of liquid crystal using an electric field to display a picture. The liquid crystal display may be largely classified as a vertical electric field type and a horizontal electric field type based upon a driving direction of the electric field for the liquid crystal.

The liquid crystal display of a vertical electric field applying type drives a liquid crystal in a twisted nematic (TN) mode using a vertical electric field formed between a pixel electrode and a common electrode arranged in opposition to each other on the upper and lower substrate. The liquid crystal display of the vertical electric field applying type has an advantage of a large aperture ratio while having a drawback of a narrow viewing angle of about 90°.

The liquid crystal display of a horizontal electric field applying type drives a liquid crystal in an in plane switching (IPS) mode using a horizontal electric field between the pixel electrode and the common electrode arranged parallel to each other on the lower substrate. The liquid crystal display of the horizontal electric field applying type has an advantage of a wide viewing angle of about 160°.

Hereinafter, the liquid crystal display of horizontal electric field applying type will be described in detail.

FIG. 1 is a block diagram showing a configuration of a related art liquid crystal display of a horizontal electric field applying type.

In FIG. 1, the related art liquid crystal display of the horizontal electric field applying type includes, a liquid crystal display panel 10, a data driver 2 for driving data lines DL of the liquid crystal display panel 10, a gate driver 4 for driving gate lines GL of the liquid crystal display panel 10, a timing controller 6 for controlling the gate driver 4 and the data driver 2, and a common voltage generator 8 for supplying a reference voltage signal to common lines CL of the liquid crystal display panel 10.

The timing controller 6 supplies pixel data signals R, G and B Data input from the exterior thereof to the data driver 2. Further, the timing controller 6 generates gate control signals GDC and data control signals DDC for driving the gate driver 4 and the data driver 2, respectively, in response to control signals H, V, DE and CLK input from the exterior thereof.

The gate control signals GDC include, for example, a gate start pulse GSP, a gate shift clock GSC and a gate output enable signal GOE, etc. The data control signals DDC include, for example, a source start pulse SSP, source shift clock signal SSC, a source output enable signal SOE and a polarity control signal POL, etc.

The gate driver 4 sequentially applies scanning pulses to the gate lines GL1 to GLn in response to gate control signals GDC from the timing controller 6. Thus, the gate driver 4 allows thin film transistors TFT connected to the gate line GL1 to GLn to be driven for each gate line GL.

The data driver 2 applies pixel voltage signals for each horizontal line to the data lines DL1 to DLm every horizontal period H1, H2, . . . in response to the data control signals DDC from the timing controller 6. Particularly, the data driver 2 converts digital pixel data R, G and B from the timing controller 6 to analog voltage signals using gamma voltages from a gamma voltage generator (not shown).

The common voltage generator 8 generates a common voltage Vcom and applies the common voltage Vcom, via a common line CL, to a common electrode for making a horizontal electric field along with the pixel electrode.

The liquid crystal display panel 10 includes thin film transistors TFT provided at each crossing between n gate lines GL1 to GLn and m data lines DL1 to DLm, and liquid crystal cells Clc connected to the thin film transistors TFT and arranged in a matrix type.

The thin film transistor TFT applies data from the data lines DL1 to DLm to the liquid crystal cell Clc from a gate signal from the gate lines GL1 to GLn. Since the liquid crystal cell consists of a pixel electrode 12 connected to the thin film transistor TFT, and a common electrode 14 provided parallel to the pixel electrode 12 to make a horizontal electric field and connected to the common line CL as shown in FIG. 2, it can be equivalently expressed as a liquid crystal capacitor Clc. Such a liquid crystal cell includes a storage capacitor Cst consisting of the common line CL and the pixel electrode 12 overlapping with each other with having at least one layer of insulating film so as to keep a pixel voltage signal charged in the liquid crystal capacitor Clc until the next pixel voltage signal is charged therein.

In such an LCD, driving systems such as line inversion, column inversion and dot inversion are used to drive the liquid crystal cells on the liquid crystal display panel.

As shown in FIG. 3A and FIG. 3B, the dot inversion driving system allows pixel voltage signals having polarities opposite to other liquid crystal cells being adjacent to each other in the horizontal and vertical directions to be applied to the liquid crystal cells, and allows the polarities of the pixel voltage signals to be inverted for each frame. The dot inversion driving system cancels cross talk generated between the liquid crystal cells that are adjacent in the vertical and horizontal directions with respect to each other, thereby providing a better picture quality than other inversion systems.

In the liquid crystal cells shown in FIG. 1 and FIG. 2 driven by such a dot inversion driving system, positive(+) and negative(−) pixel voltage signals Vd are alternately applied in an alternating current type for each vertical period 1V, while a common voltage signal Vcom supplied to the common line CL is applied in a direct current type as shown in FIG. 4. Thus, the pixel voltage signal Vd applied to the pixel electrode 12 and the common voltage signal Vcom applied to the common electrode 14 have a desired voltage difference ΔV having a relatively low level from each other. Accordingly, in order to change an alignment of the liquid crystal to a desired angle, there is required a pixel voltage signal Vd having a relatively high level on a basis of the common voltage signal Vcom. Such a requirement raises a problem in that the data driver for generating the pixel voltage signal Vd has a relatively high cost.

Furthermore, a horizontal electric field formed by the voltage difference between the pixel voltage signal Vd and the common voltage signal Vcom is more increased as a distance between the pixel electrode 12 and the common electrode 14 goes closer than as a distance between the two electrodes 12 and 14 goes farther. Thus, it becomes possible to obtain a desired horizontal electric field even though the pixel voltage signal Vd supplied to the pixel electrode 12 when the pixel electrode 12 and the common electrode 14 are close to each other is lower than the pixel voltage signal Vd supplied to the pixel electrode 12 when they are far from each other. However, there is raised a problem in that, as a distance between the two electrodes 12 and 14 gets closer, an area transmitted by a light is narrowed, thereby lowering an aperture ratio. On the other hand, there is raised a problem in that, if a distance between the two electrodes 12 and 14 goes far in order to enhance an aperture ratio, then an output value of the pixel voltage signal Vd supplied to the pixel electrode 12 becomes high, thereby increasing a cost of the data driver 2.

In the related art LCD, the gate driver 4 and the data driver 2 are separated into a plurality of integrated circuits (IC's) to be manufactured into a chip shape. Each of the drive IC's is mounted onto an IC area opened on a tape carrier package (TCP) or mounted onto a base film of the TCP by a chip on film (COF) system, and is electrically connected to the liquid crystal display panel 10 by a tape automated bonding (TAB) system.

The drive IC's mounted onto the liquid crystal display panel 10 by the TCP are connected, via a flexible printed circuit (FPC) and a sub printed circuit board (PCB), to a timing controller and a power source of a main PCB. More specifically, the data drive IC's receive data control signals and pixel data from the timing controller mounted, via the FPC and the data PCB, onto the main PCB; and power signals from the power source. The gate drive IC's receive gate control signals from the timing controller mounted, via the gate FPC and the gate PCB, onto the main PCB; and power signals from the power source.

As mentioned above, each of the gate driver 4 and the data driver 2 requires individual drive IC, TCP, PCB and FPC, etc. The related art LCD has a problem in that it is difficult to have a thin design due to a weight occupied by the individual elements.

SUMMARY OF THE INVENTION

Accordingly, the present invention is directed to a liquid crystal display device and a driving method thereof.

An advantage of the present invention to provide a liquid crystal display device and a fabricating method thereof for lowering power consumption as well as integrating a driver on a substrate.

To achieve these and other advantages of the invention, a liquid crystal display device according to one aspect of the present invention includes a liquid crystal display panel having thin film transistors provided at crossings between gate lines and data lines on a substrate and connected in a zigzag pattern based on the gate lines, pixel electrodes connected to the thin film transistors, common electrodes for making a horizontal electric field with the pixel electrodes, and common lines connected to the common electrodes and arranged substantially parallel to the gate lines; a gate driver for applying scanning pulse signals to the gate lines of the liquid crystal display panel; a data driver for applying pixel voltage signals to the data lines of the liquid crystal display panel; and a common driver for applying alternating current common voltage signals to the common lines of the liquid crystal display panel, wherein the gate driver and the common driver are integrated on the substrate.

A method of driving a liquid crystal display device having a liquid crystal display panel including thin film transistors provided at crossings between gate lines and data lines on a substrate and connected in a zigzag pattern based on the gate lines, pixel electrodes connected to the thin film transistors, common electrodes for making a horizontal electric field with the pixel electrodes and common lines connected to the common electrodes and arranged substantially parallel to the gate lines, and a common driver and a gate driver integrated on a substrate of the liquid crystal display panel to drive the common lines and the gate lines, respectively, the method comprising applying scanning pulse signals to the gate lines; applying pixel voltage signals to the data lines; and applying alternating current common voltage signals to the common lines of the liquid crystal display panel.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings:

FIG. 3A and FIG. 3B are views explaining a dot inversion system in a method of driving the liquid crystal display shown in FIG. 1;

DETAILED DESCRIPTION OF THE ILLUSTRATED EMBODIMENTS

Reference will now be made in detail to the embodiments of the present invention, examples of which are illustrated in the accompanying drawings.

Hereinafter, the embodiments of the present invention will be described in detail with reference to FIGS. 5 to 15.

Figure 1:
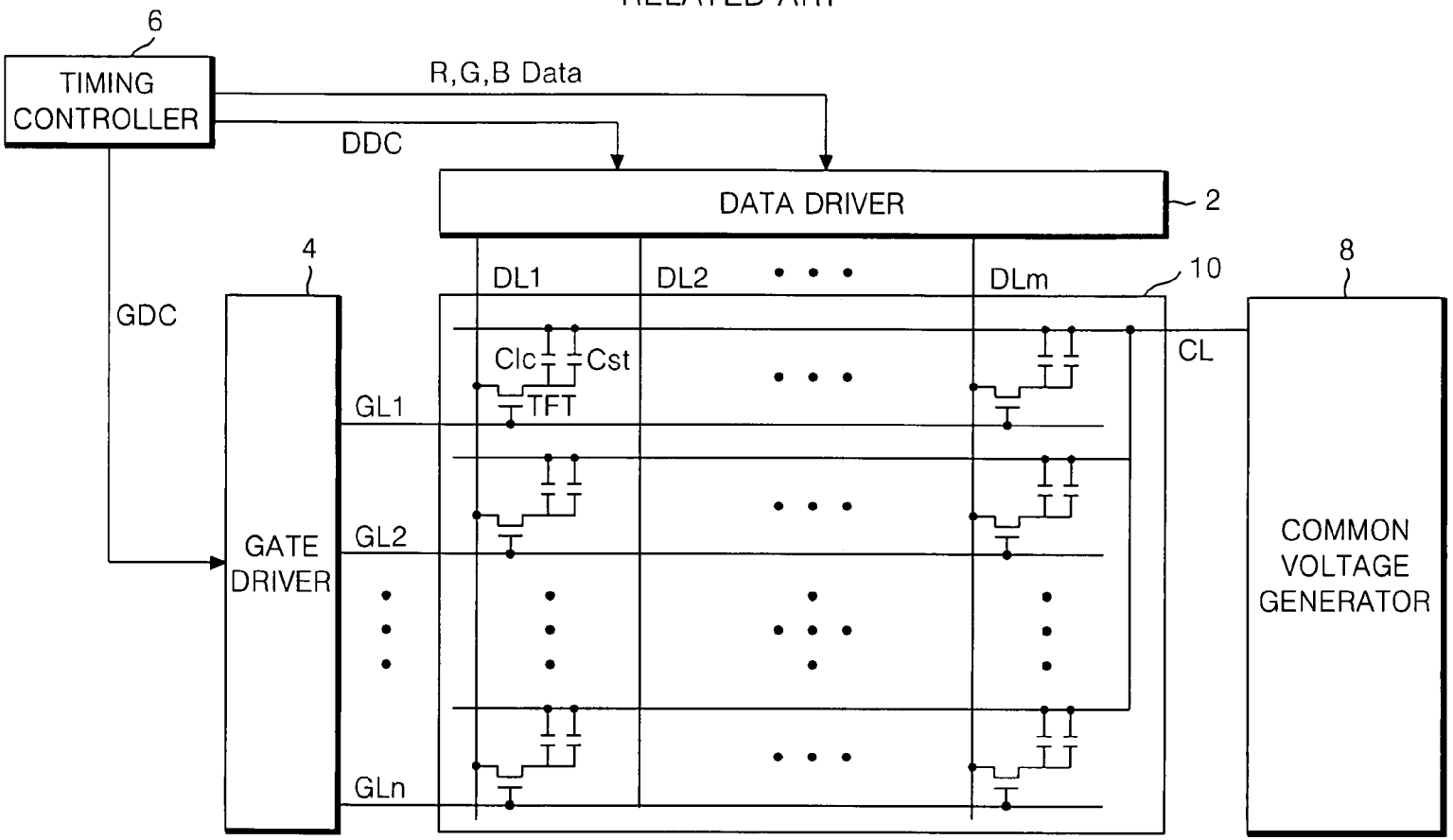
FIG. 1 RELATED ART
FIG. 1 is a schematic block diagram showing a configuration of a related art liquid crystal display of a horizontal electric field applying type.
Figure 2:
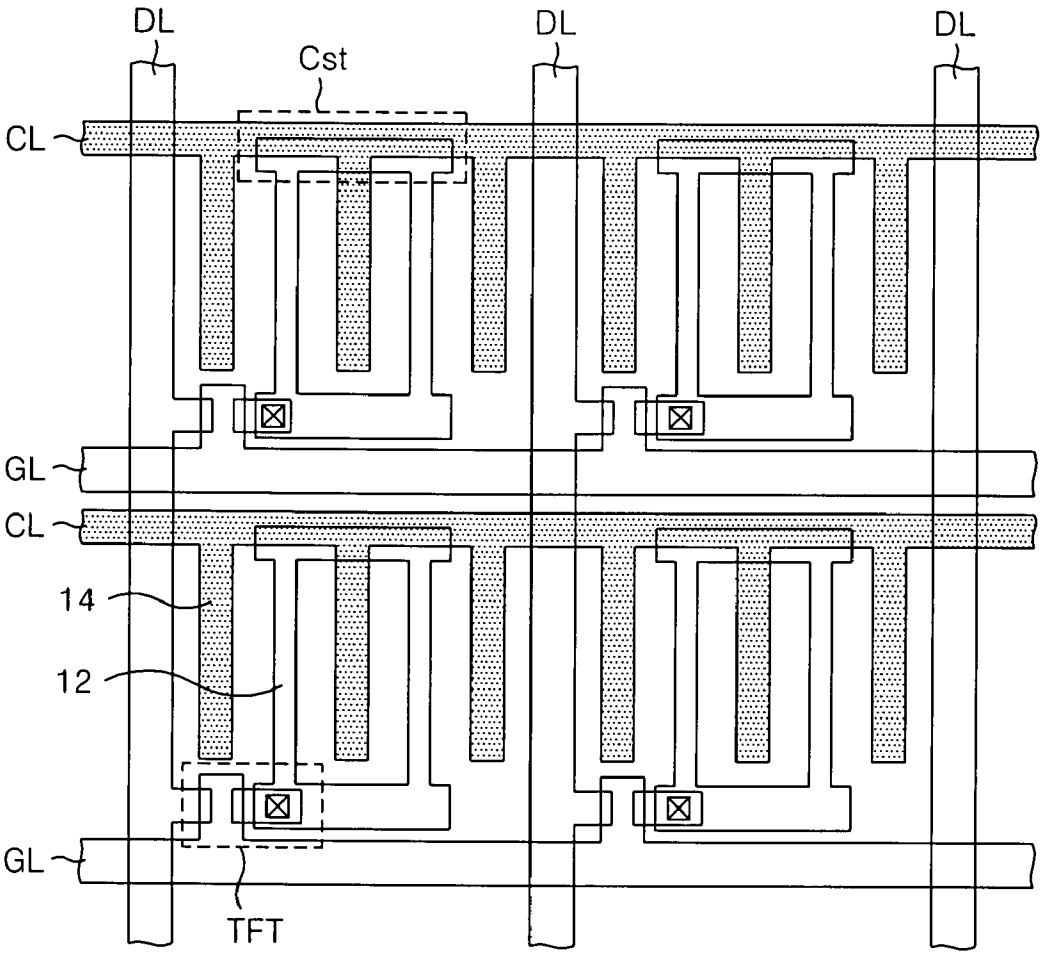
FIG. 2 RELATED ART
FIG. 2 is a detailed plan view of the liquid crystal display panel shown in FIG. 1.
Figure 4:
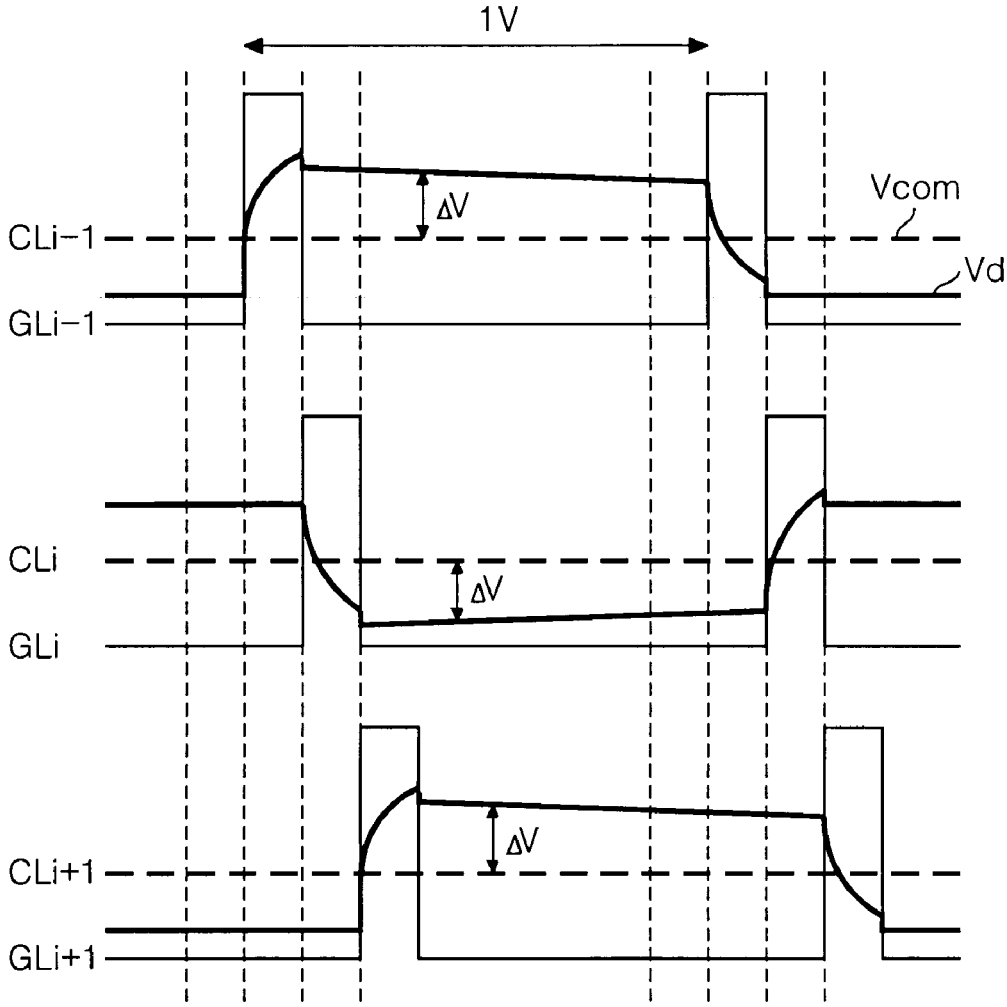
FIG. 4 RELATED ART
FIG. 4 is a waveform diagram of pixel voltage signals and common voltage signals applied to the liquid crystal cells shown in FIG. 2.
Figure 5:
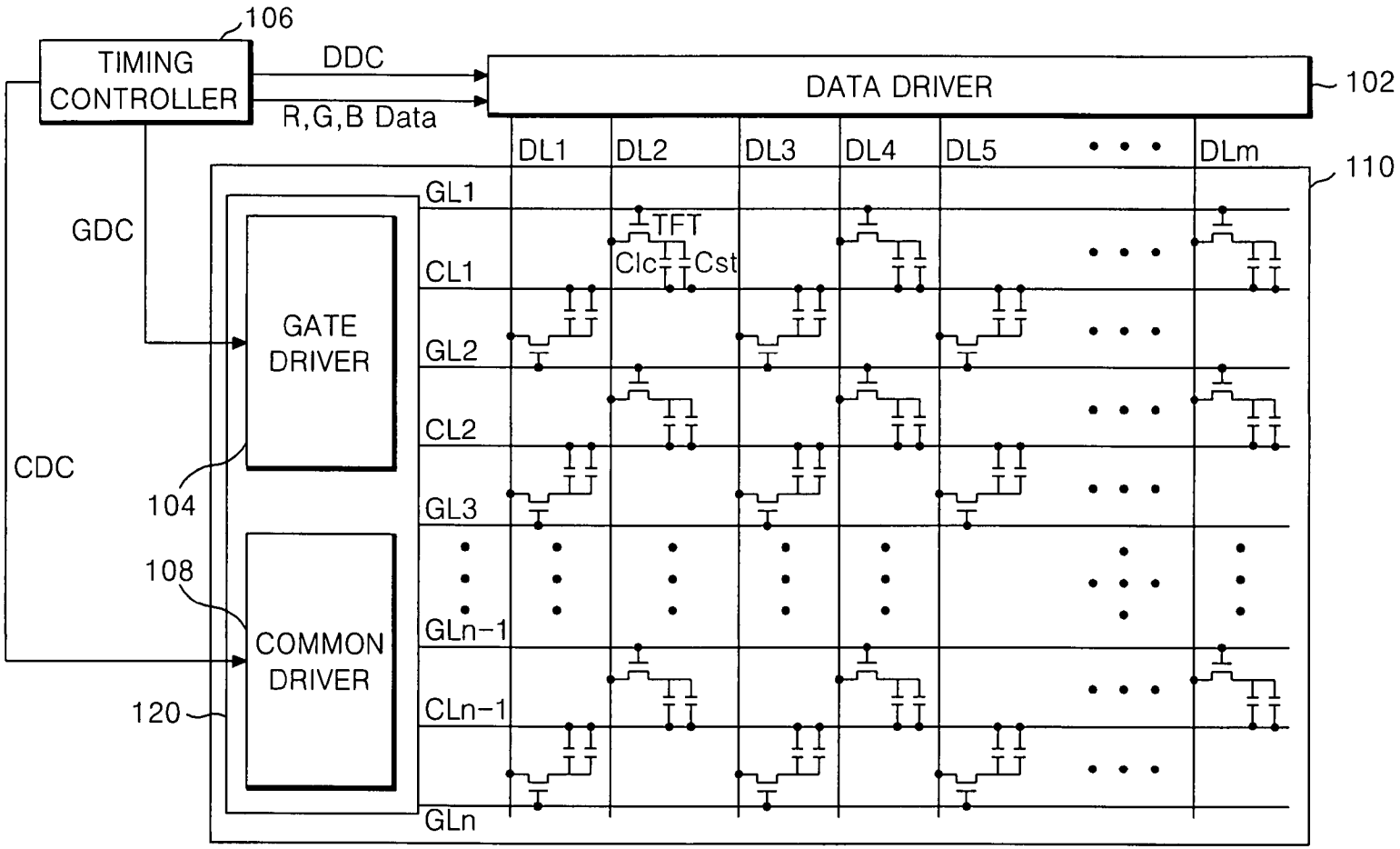
FIG. 5 is a schematic block diagram showing a configuration of a liquid crystal display according to a first embodiment of the present invention.

FIG. 5 shows a liquid crystal display (LCD) of a horizontal electric field applying type according to a first embodiment of the present invention.

In FIG. 5, the LCD of a horizontal electric field applying type includes a liquid crystal display panel 110, a data driver 102 for driving data lines DL of the liquid crystal display panel 110, a signal driver 120 integrally provided with a gate driver 104 for driving gate lines GL of the liquid crystal display panel 110 and a common driver 108 for driving common lines CL of the liquid crystal display panel 110, and a timing controller 106 for controlling the signal driver 120 and the data driver 102.

Figure 6A:
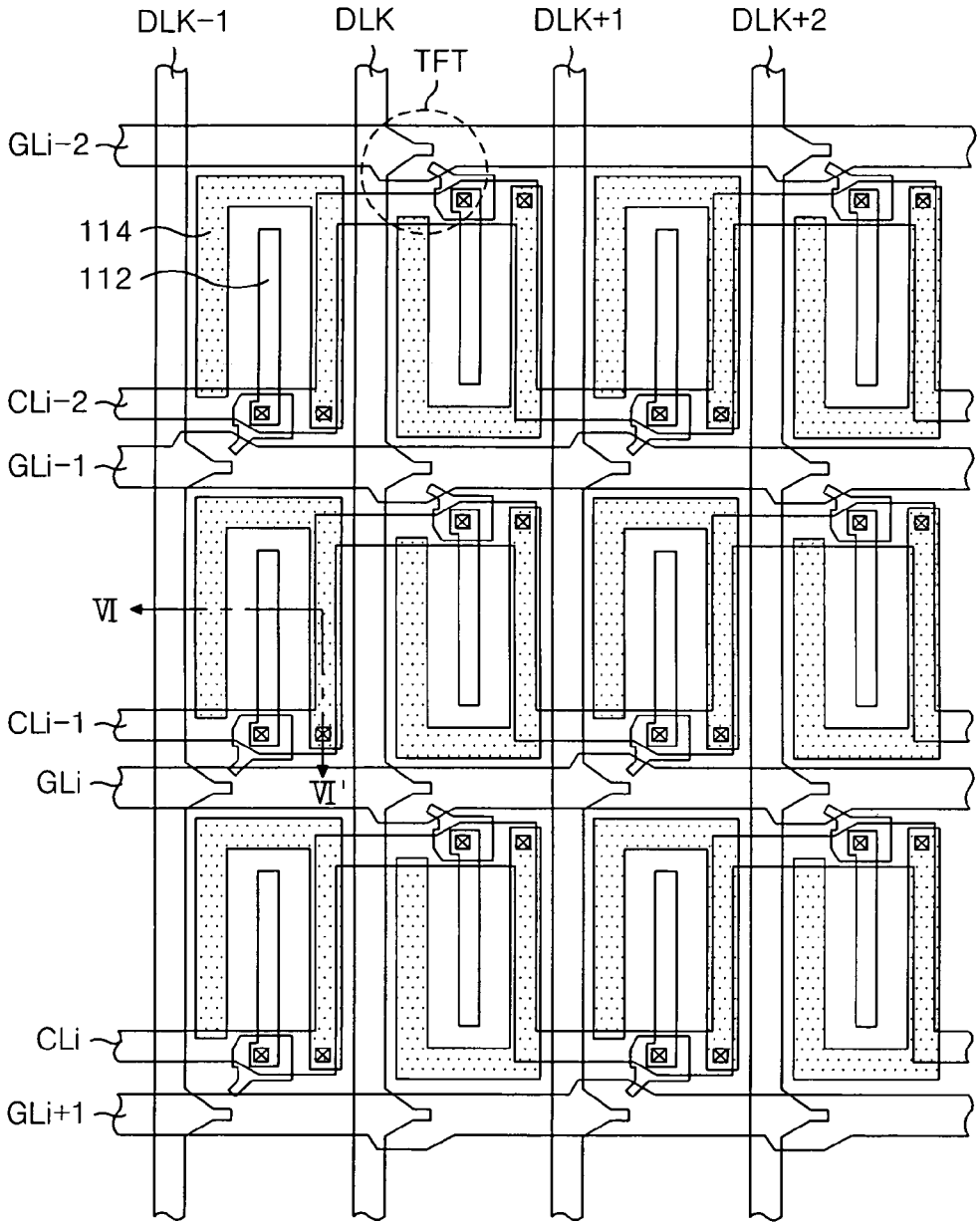
FIG. 6A and FIG. 6B are a detailed plan view and a detailed section view of the liquid crystal display panel shown in FIG. 5, respectively.
Figure 6B:
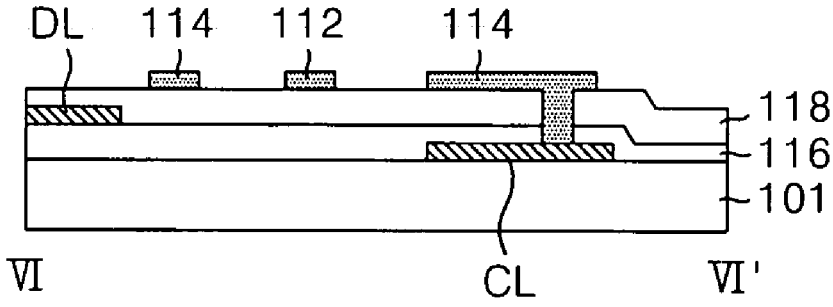

The liquid crystal display panel 110 includes gate lines GL, and data lines DL crossing the gate lines GL on an insulation basis. Liquid crystal cells are provided for each area defined by the crossing between the gate lines GL and the data lines DL. As shown in FIG. 6A and FIG. 6B, each of the liquid crystal cells includes a thin film transistor TFT connected to any one of the gate lines GL and any one of the data lines DL, and a liquid crystal capacitor Clc consisting of a pixel electrode 112 connected to the thin film transistor TFT and a common electrode 114 provided substantially parallel to the pixel electrode 112 to make a horizontal electric field and connected to the common line CL. Each of the liquid crystal cells further includes a storage capacitor Cst for keeping a data voltage charged in the liquid crystal capacitor Clc until the next data voltage is charged therein. Herein, the pixel electrode 112 and the common electrode 114 may be formed from a transparent conductive material on a protective film 118. The pixel electrode 112 is electrically connected, via a contact hole exposing a drain electrode of the thin film transistor TFT, to the drain electrode while the common electrode 114 is electrically connected, via a contact hole passing through a gate insulating film 116 and a protective film 118, to the common line CL formed in a square pulse shape.

The thin film transistor TFT applies a pixel voltage signal from the corresponding data line DL to the liquid crystal cell in response to a scanning signal, that is, a gate signal from the corresponding gate line GL.

Particularly, the thin film transistor TFT may be connected in a zigzag pattern along the gate line GL. Thus, the liquid crystal cells driven by the gate lines GL are arranged in a zigzag pattern on a basis of the corresponding gate line GL. In other words, the liquid crystal cells configured on the same horizontal line are driven alternately for each column by different gate lines GL. Thus, the liquid crystal cells arranged in a zigzag pattern at two adjacent horizontal lines are driven whenever each gate line GL is driven, so that each horizontal line is driven by two gate lines GL.

More specifically, the liquid crystal cells at the odd-numbered columns connected, via the thin film transistors TFT, to the odd-numbered data lines DL1, DL3, . . . , DLm−1 are driven by the gate lines GL2 to GLn being adjacent to each other at the lower side thereof. On the other hand, the liquid crystal cells at the even-numbered columns connected, via the thin film transistors TFT, to the even-numbered data lines DL2, DL4, . . . , DLm are driven by the gate lines GL1 to GLn−1 being adjacent to each other at the upper side thereof. In other words, the liquid crystal cells at the odd-numbered columns, of the liquid crystal cells at the ith horizontal line, are driven by the (i+1)th gate line GLi+1, while the liquid crystal cells at the even-numbered columns are driven by the ith gate line GLi.

For instance, the liquid crystal cells at the odd-numbered columns of the liquid crystal cells at the first horizontal line, are driven by the second gate line GL2, while the liquid crystal cells at the even-numbered columns are driven by the first gate line GL1. Likewise, the liquid crystal cells at the odd-numbered columns of the liquid crystal cells at the nth horizontal line are driven by the nth gate line GLn, while the liquid crystal cells at the even-numbered columns are driven by the (n−1)th gate line GLn−1. On the other hand, liquid crystal cells at the odd-numbered columns of the liquid crystal cells at the first horizontal line, are driven by the first gate line GL1, while the liquid crystal cells at the even-numbered columns are driven by the second gate line GL2. Likewise, the liquid crystal cells at the odd-numbered columns of the liquid crystal cells at the nth horizontal line are driven by the (n−1)th gate line GLn−1, while the liquid crystal cells at the even-numbered columns are driven by the nth gate line GLn.

As mentioned above, the liquid crystal cells arranged in a zigzag pattern at two adjacent horizontal lines are driven whenever each of the gate lines GL1 to GLn is driven, so that, when pixel voltage signals are charged in the liquid crystal cells by the dot inversion system, the liquid crystal panel 110 is driven by the horizontal line inversion system.

Figure 7A:
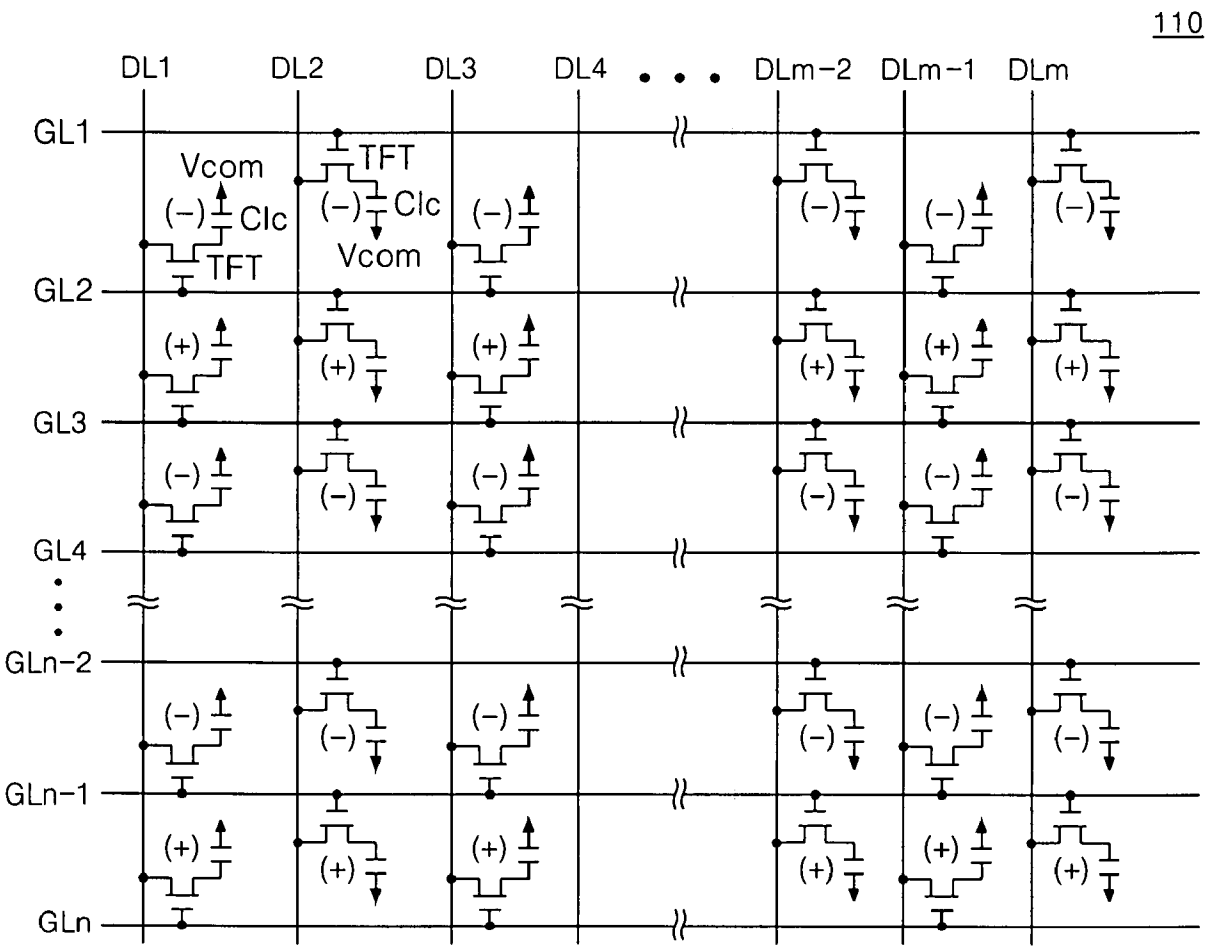
FIG. 7A and FIG. 7B illustrate the polarities of pixel voltage signals applied to the liquid crystal cells shown in FIG. 5 at the odd and even frames by the dot inversion system.

For example, in one frame interval as shown in FIG. 7A, when the first gate line GL1 is driven, negative(−) pixel voltage signals are charged in the even-numbered liquid crystal cells at the first horizontal line. Next, when the second gate line GL2 is driven, negative(−) pixel voltage signals are charged in the odd-numbered liquid crystal cells at the first horizontal line while positive(+) pixel voltage signals are charged in the even-numbered liquid crystal cells at the second horizontal line. When the third gate line GL3 is driven, positive(+) pixel voltage signals are charged in the odd-numbered liquid crystal cells at the second horizontal line while negative(−) pixel voltage signals are charged in the even-numbered liquid crystal cells at the third horizontal line. Thus, negative(−) pixel voltage signals are charged in the liquid crystal cells at the first horizontal line, and positive(+) pixel voltage signals are charged in the liquid crystal cells at the second horizontal line. As a result, the liquid crystal display panel 110 is driven by the horizontal line inversion system.

Figure 7B:
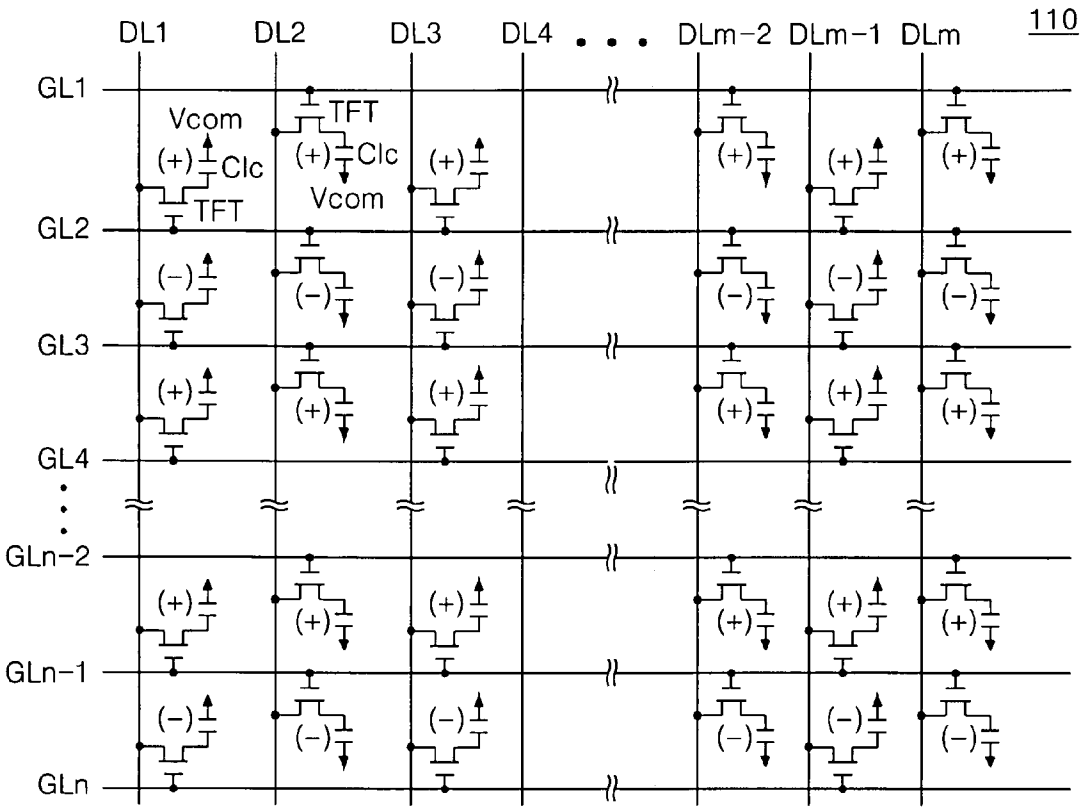

In the next frame interval as shown in FIG. 7B, when the first gate line GL1 is driven, positive(+) pixel voltage signals are charged in the even-numbered liquid crystal cells at the first horizontal line. Next, when the second gate line GL2 is driven, positive(+) pixel voltage signals are charged in the odd-numbered liquid crystal cells at the first horizontal line while negative(−) pixel voltage signals are charged in the even-numbered liquid crystal cells at the second horizontal line. When the third gate line GL3 is driven, negative(−) pixel voltage signals are charged in the odd-numbered liquid crystal cells at the second horizontal line while positive(+) pixel voltage signals are charged in the even-numbered liquid crystal cells at the third horizontal line. Thus, positive(+) pixel voltage signals are charged in the liquid crystal cells at the first horizontal line, and negative(−) pixel voltage signals are charged in the liquid crystal cells at the second horizontal line. As a result, the liquid crystal display panel 110 is driven by the horizontal line inversion system.

The timing controller 106 supplies pixel data signals R, G and B Data input from the exterior thereof to the data driver 102. Further, the timing controller 106 generates data control signals DDC, gate control signals GDC and common control signals CDC for driving the data driver 102 and the gate driver 104 and the common driver 108 included in the signal line driver 120, respectively, in response to control signals H, V, DE and CLK input from the exterior thereof.

The gate control signals GDC include, for example, a gate start pulse GSP, a gate shift clock GSC and a gate output enable signal GOE, etc. The data control signals DDC include, for example, a source start pulse SSP, source shift clock signal SSC, a source output enable signal SOE and a polarity control signal POL, etc. The common control signals CDC include a common start pulse CSP and a common shift clock signal CSC, etc.

The data driver 102 applies pixel signals for each horizontal line to the data lines DL1 to DLm every horizontal period H1, H2, . . . in response to the data control signals DDC from the timing controller 106. Particularly, the data driver 102 converts digital pixel data R, G and B from the timing controller 106 to analog pixel signals using gamma voltages from a gamma voltage generator (not shown). The data driver 102 applies the pixel voltage signals using the dot inversion system such that the polarities of the pixel voltage signals are different for each horizontal line interval and each vertical line interval.

The signal driver 120 is provided by integrating the gate driver 104 for driving the gate lines GL with the common driver 108 for driving the common lines CL on the substrate 101 of the liquid crystal display panel 110. To this end, the gate driver 104 and the common driver 108 included in the signal driver 120 are provided simultaneously by the same process as the thin film transistor TFT formed at the display area of the liquid crystal display panel 110. The thin film transistor TFT provided at the signal driver 120 may be made from polycrystalline silicon thin film transistor or amorphous silicon thin film transistor having a high charge mobility. For instance, the gate driver 104 and the common driver 108 may be integrated on the substrate 101 by the CMOS process using a low-temperature polycrystalline silicon thin film transistor. As show in FIG. 5, an output line of the signal driver 120 is provided such that a gate output line connected to the gate line GL and a common output line connected to the common line CL are alternately arranged.

The gate driver 104 built in the signal driver 120 sequentially applies scanning pulses to the gate lines GL1 to GLn in response to the gate control signals GDC from the timing controller 106. Thus, the gate driver 104 allows the thin film transistors TFT connected to the gate lines GL1 to GLn to be driven for each gate line GL.

Figure 8:
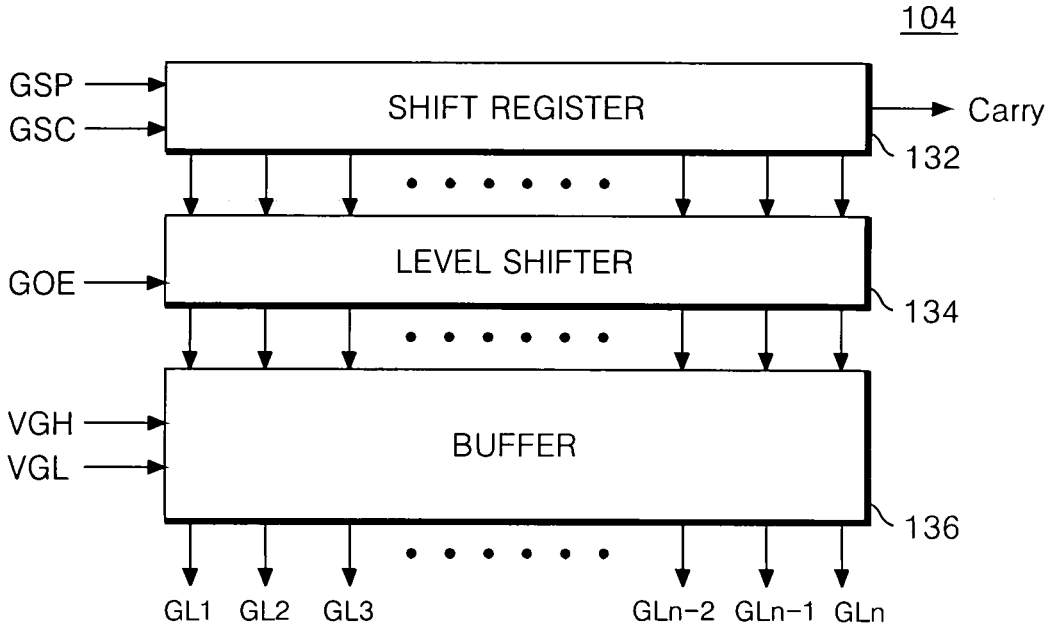
FIG. 8 is a detailed block diagram of the gate driver shown in FIG. 5.

To this end, as shown in FIG. 8, the gate driver 104 includes a shift register 132 for sequentially generating scanning pulses, a level shifter 134 for shifting a swing width of a voltage of the scanning pulse in such a manner to be suitable for driving the liquid crystal cell Clc, and a buffer 136 connected between the level shifter 134 and the gate line GL to serve as a voltage follower.

Hereinafter, an explanation as to each element of the gate driver 104 will be made in conjunction with FIG. 9.

Figure 9:
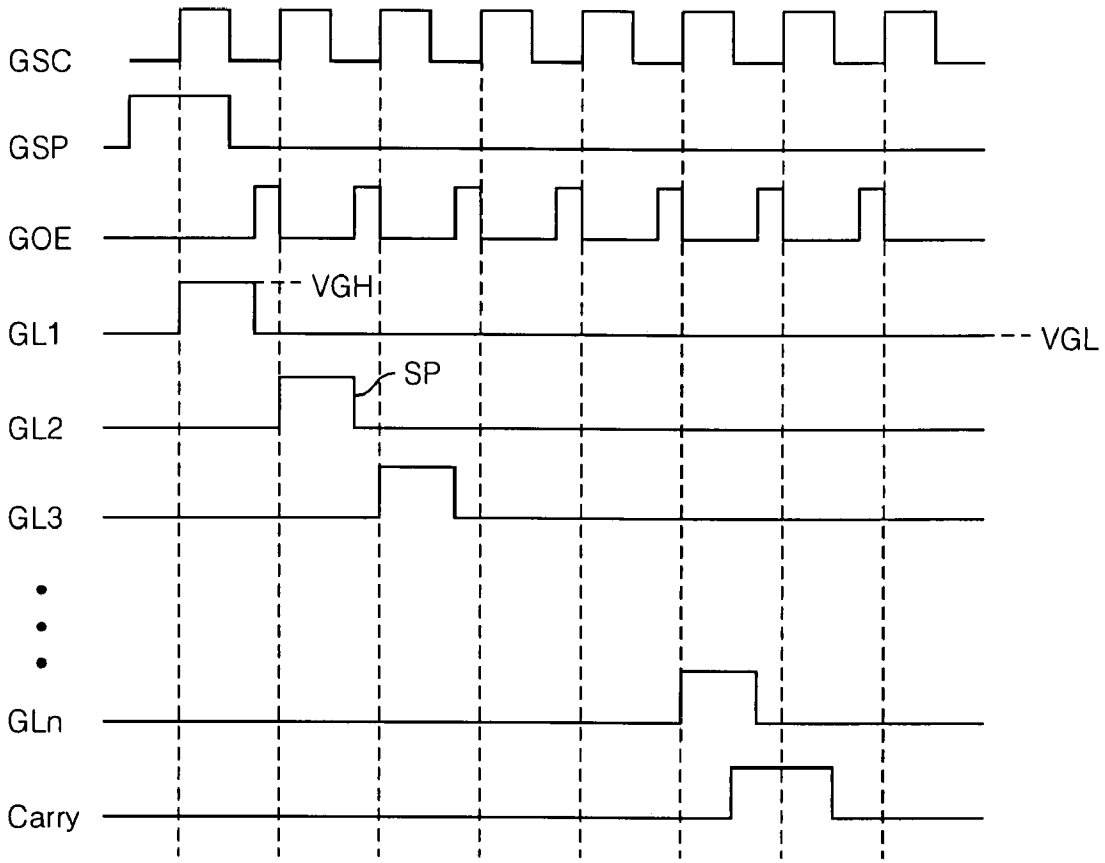
FIG. 9 is a waveform diagram of scanning pulses generated from the gate driver shown in FIG. 8.

The shift register 132 shifts the gate start pulse GSP in response to the gate shift clock signal GSC shown in FIG. 9 to thereby sequentially enable the gate lines GL. When an enable operation of the gate lines GL at one frame is finished, the shift register 132 repeats an enable operation of the gate lines GL at the next frame after sending a carry value.

The level shifter 134 makes a sequential level shifting of the scanning pulses to be applied to the gate lines GL to output them to the buffer 136. In other words, the level shifter 134 applies a high logic of scanning pulse VGH to the buffer 136 in response to the gate enable signal GOE when the gate shift clock signal GSC has a high logic while applying a low logic of scanning pulse VGL to the butter 136 in response to the gate enable signal GOE when the gate shift clock signal GSC has a low logic.

The buffer 136 generates an output voltage having the same voltage level and polarity as a scanning pulse input from the level shifter 134, and restrains a variation in the output voltage to apply it to the gate line GL. The scanning pulse SP output via the buffer 136 is sequentially applied to the gate lines GL as shown in FIG. 9.

The common driver 108 applies a sequentially inverted common voltage signal Vc to the common lines CL in response to the common control signals CDC from the timing controller 106. The common voltage signal Vc has the polarity inverted for each vertical period in an alternating current type, and has a polarity opposite to the pixel voltage signal Vd.

Figure 10:
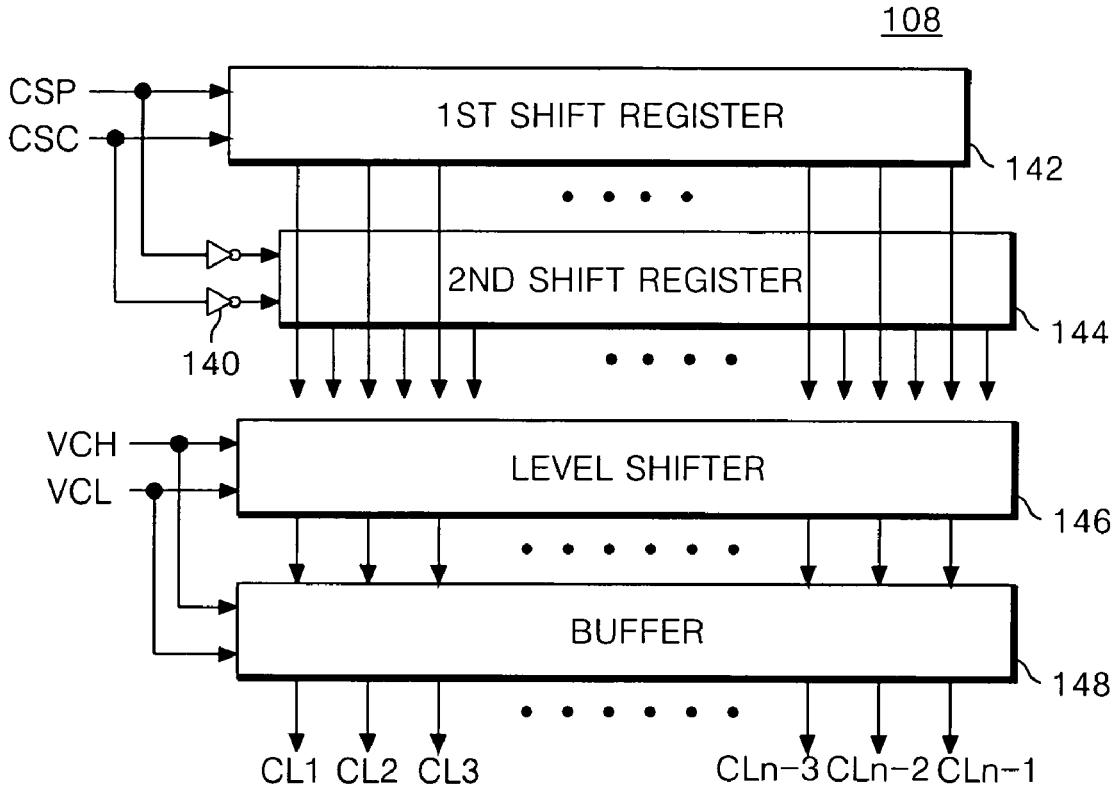
FIG. 10 is a detailed block diagram of the common driver shown in FIG. 5.

To this end, as shown in FIG. 10, the common driver 108 includes first and second shift registers 142 and 144 for sequentially generating common voltage signals, a level shifter 146 for shifting a swing width of the common voltage signal in such a manner to be suitable for driving the liquid crystal cell Clc, and a buffer 148 connected between the level shifter 146 and the common line CL to serve as a voltage follower.

Hereinafter, an explanation as to each element of the common driver 108 will be made in conjunction with FIG. 11.

The first shift register 142 shifts a common start pulse CSP having one vertical period 1V in response to the common shift clock signal CSC having two horizontal periods 2H to thereby sequentially enable the common lines CL. In other words, the first shift register 142 shifts the common start pulse CSP for each two horizontal periods when the common shift clock signal CSC has a high logic.

The second shift register 144 shifts a common start pulse CSP inverted by an inverter 140 in response to a common shift clock CSC inverted by the inverter 140 to thereby sequentially enable the common lines CL. In other words, the second shift register 144 shifts the common start pulse CSP having the inverted polarity for each two horizontal periods when the common shift clock signal CSC inverted by the inverter 140 has a high logic.

The level shifter 146 sequentially level-shifts the shifted high (or low) logic common start pulse CSP by the high (or low) logic common voltage signal to output it to the buffer 148. In other words, the level shifter 146 applies a high logic of common voltage signal VCH to the buffer 148 when the common start pulse CSP has a high logic while applying a low logic of common voltage signal VCL to the buffer 148 when the common start pulse CSP has a low logic.

The buffer 148 generates an output voltage having the same voltage level and polarity as a voltage input from the level shifter 146, and restrains a variation in the output voltage to apply it to the common line CL. The common voltage signal output via the buffer 148 is sequentially applied to the common lines CL as shown in FIG. 11.

Figure 11:
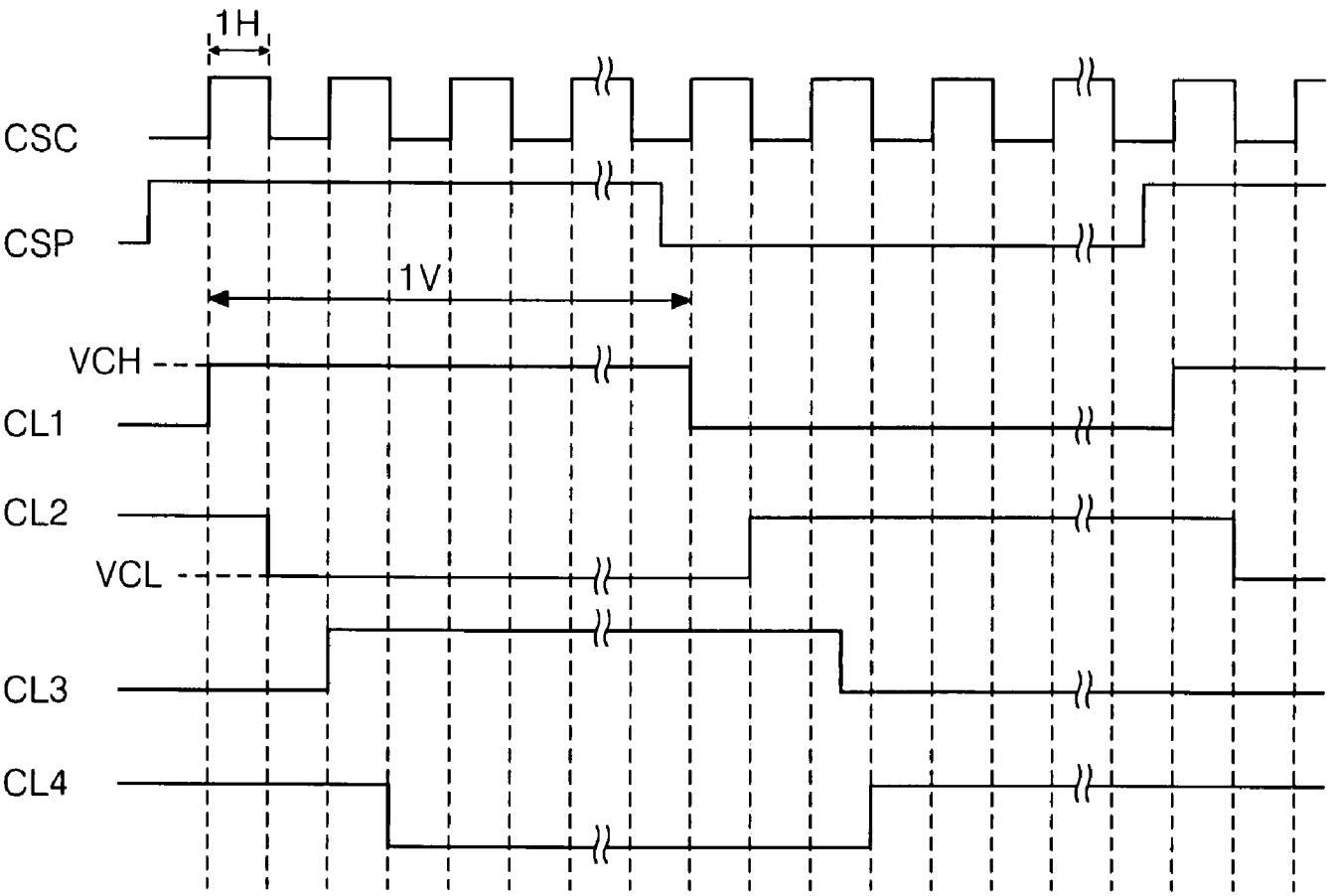
FIG. 11 is a waveform diagram of common voltage signals generated from the common driver shown in FIG. 10.

The common driver 108 generates common voltage signals VCH and VCL having the polarities inverted for each vertical period as shown in FIG. 11.

Figure 12A:
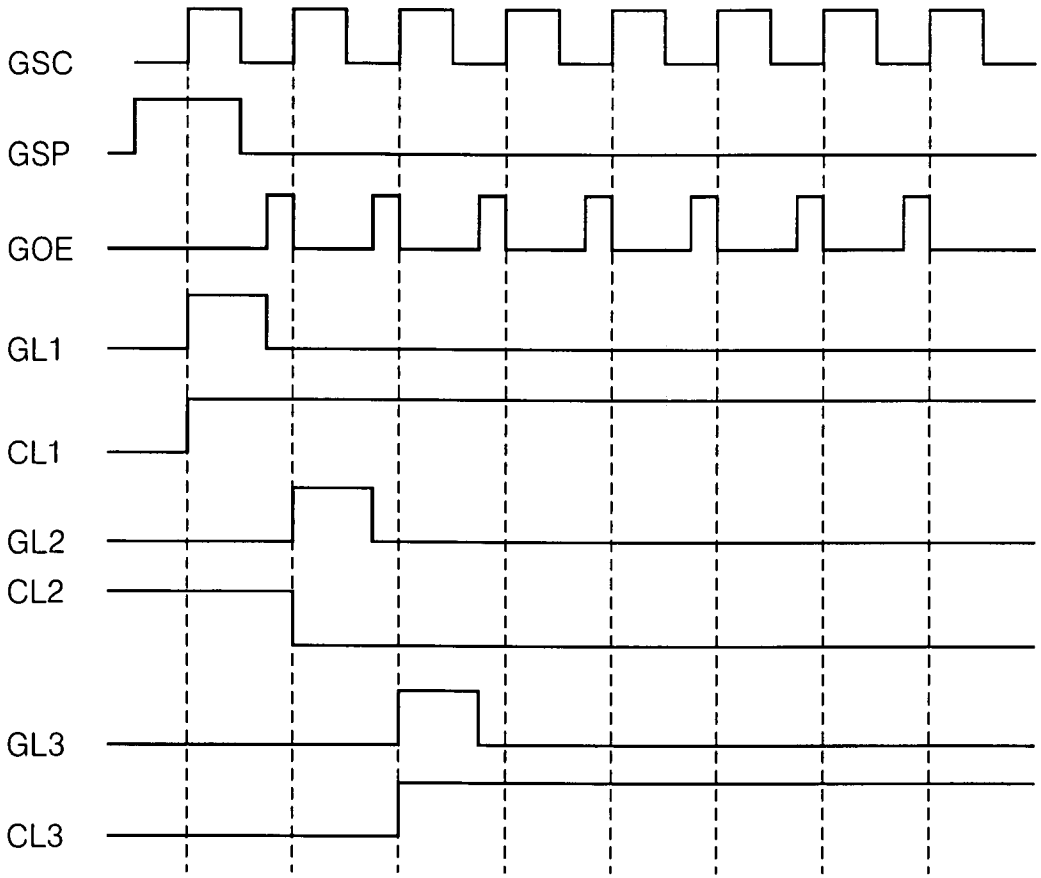
FIG. 12A and FIG. 12B are waveform diagrams showing various shapes of the common voltage signals shown in FIG. 11.
Figure 12B:
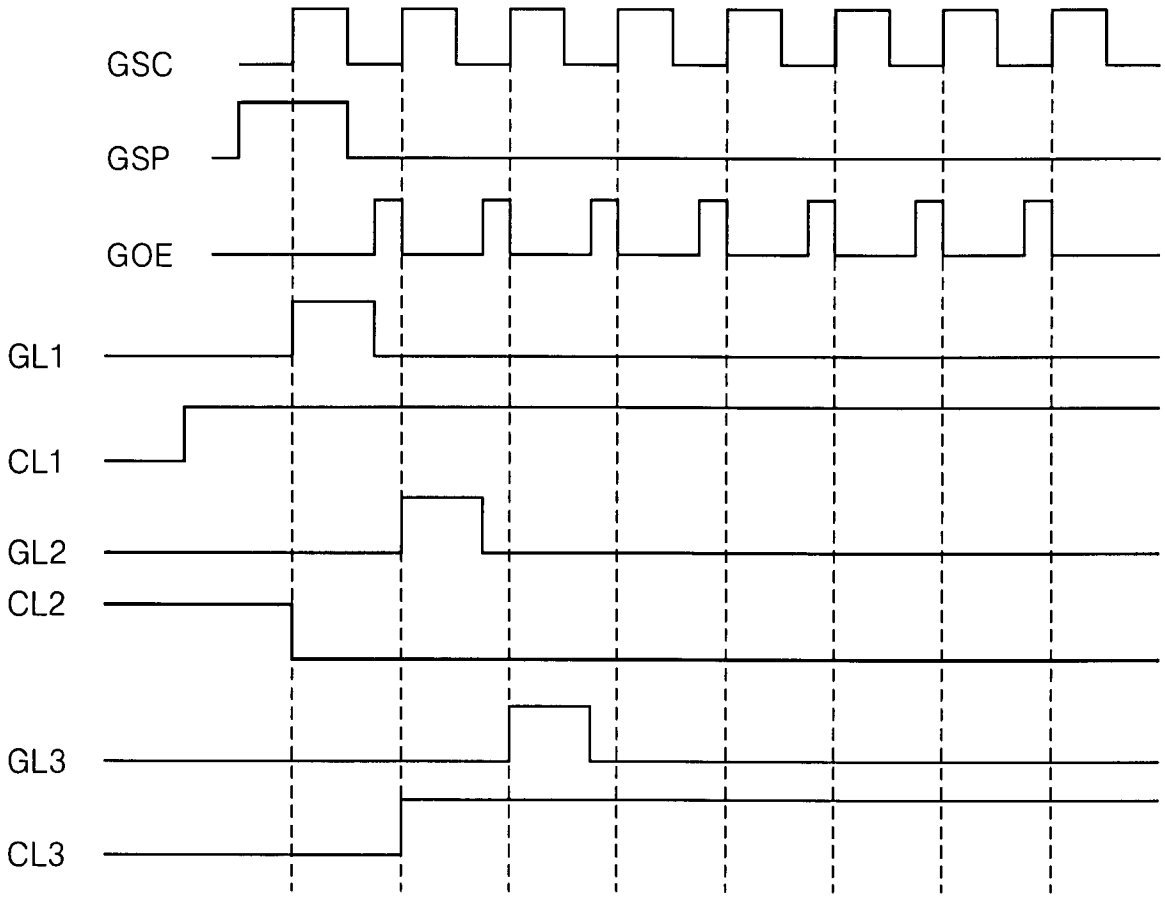

Meanwhile, the common voltage signal is inverted simultaneously with the scanning pulse as shown in FIG. 12A, or is inverted n horizontal periods H (wherein n is an integer) prior to the scanning pulse as shown in FIG. 12B. The common voltage signal, as shown in FIG. 12B, inverted prior to the scanning pulse maintains a more stable state than the common voltage signal shown in FIG. 12A when the scanning pulse is changed to a high state, so that a stable pixel voltage signal can be applied to the liquid crystal cell.

Figure 13:
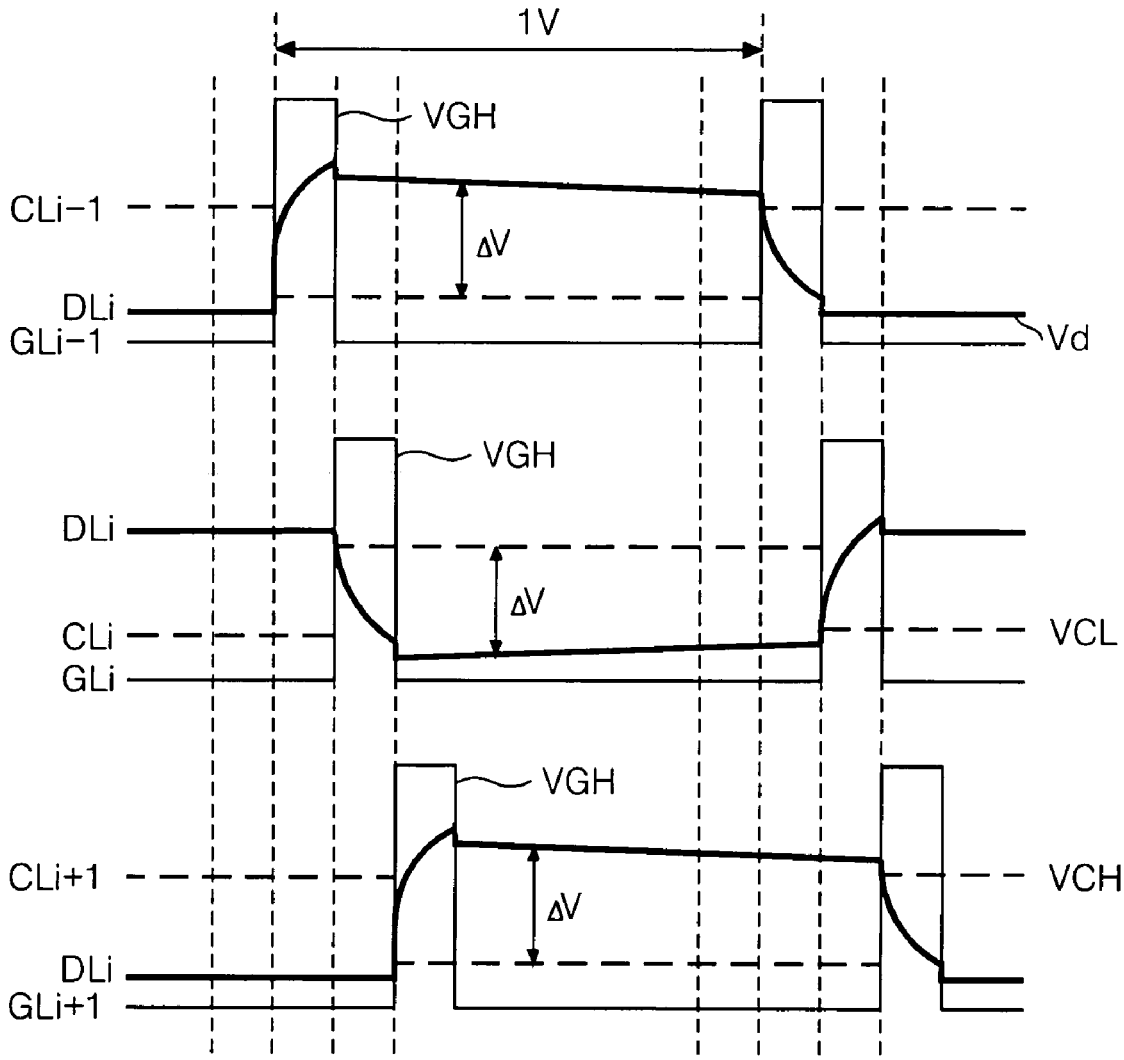
FIG. 13 is a waveform diagram of the pixel voltage signals and the common voltage signals applied to the liquid crystal cells shown in FIG. 5.

FIG. 13 is a waveform diagram of voltages applied to the liquid crystal cell according to the first embodiment of the present invention.

Referring to FIG. 13, if a gate high voltage VGH is supplied to the (i−1)th gate line GLi−1, then the liquid crystal cells connected to the (i−1)th gate line GLi−1 and the ith data line DLi are supplied with a positive pixel voltage signal Vd and a negative common voltage signal VCL during one vertical period 1V. Next, if the gate high voltage VGH is supplied to the ith gate line GLi, then the liquid crystal cells connected to the ith gate line GLi and the ith data line DLi are supplied with a negative pixel voltage signal Vd and a positive common voltage signal VCH during one vertical period 1V. Subsequently, if the gate high voltage VGH is supplied to the (i+1)th gate line GLi+1, then the liquid crystal cells connected to the (i+1)th gate line GLi+1 and the ith data line DLi are supplied with a positive pixel voltage signal Vd and a negative common voltage signal VCH during one vertical period 1V.

Even though the pixel voltage signal having a relatively low level is applied to the pixel electrode by the common voltage signal inverted during one vertical period in this manner, a liquid crystal voltage felt by the liquid crystal is equal to the prior art. Accordingly, it becomes possible to lower an output voltage level of the data drive IC in the data driver for generating the pixel voltage signal, thereby reducing power consumption. Furthermore, the pixel voltage signal output from the data driver is driven by the dot inversion system, so that it becomes possible to prevent vertical and horizontal cross talk. Moreover, the gate driver and the data driver are integrated on the substrate, so that it becomes possible to reduce a weight occupied by the TCP and the PCB, etc., thereby permitting the LCD to have a thin thickness and reduce a manufacturing cost thereof.

Figure 14:
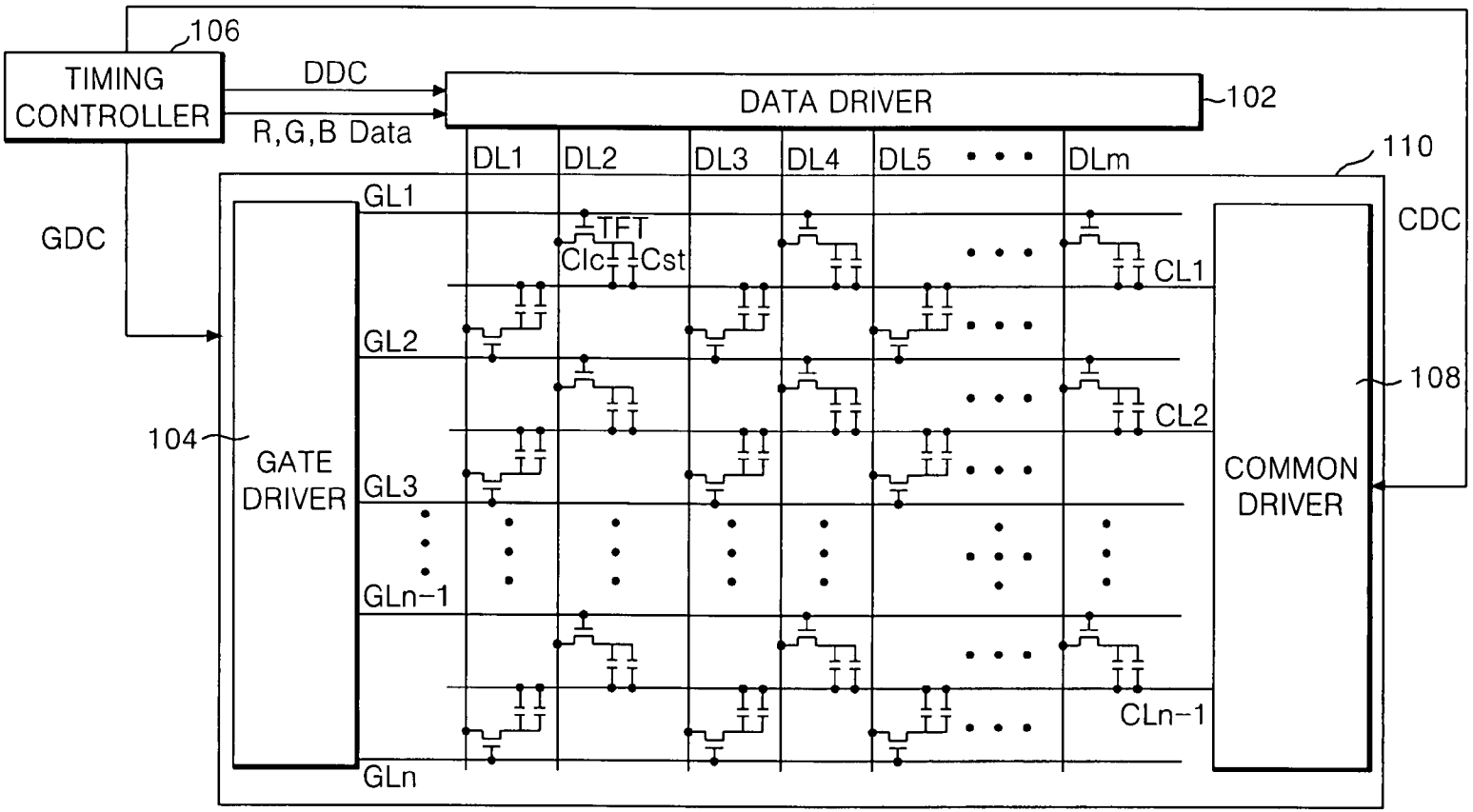
FIG. 14 is a schematic block diagram showing a configuration of a liquid crystal display according to a second embodiment of the present invention.

FIG. 14 shows a liquid crystal display (LCD) according to a second embodiment of the present invention.

Referring to FIG. 14, the LCD includes a liquid crystal display panel 110, a data driver 102 for driving data lines DL of the liquid crystal display panel 110, a gate driver 104 for driving gate lines GL of the liquid crystal display panel 110, a common driver 108 for driving common lines CL of the liquid crystal display panel 110, and a timing controller 106 for controlling the gate driver 104, the common driver 108 and the data driver 102.

The gate driver 104 is integrated on one side of a substrate of the liquid crystal display panel 110. In other words, the gate driver 104 is provided simultaneously with and by the same process as a thin film transistor TFT for switching a liquid crystal cell Clc. In this case, the thin film transistor TFT provided at the gate driver 104 is made from polycrystalline silicon thin film transistor or amorphous silicon thin film transistor having a high charge mobility. For instance, the gate driver 104 is integrated on one side of the substrate by the CMOS process.

The gate driver 104 sequentially applies scanning pulses to the gate lines GL1 to GLn in response to the gate control signals GDC from the timing controller 106. Thus, the gate driver 104 allows the thin film transistors TFT connected to the gate lines GL1 to GLn to be driven for each gate line GL.

The common driver 108 is integrated on the other side of the substrate of the liquid crystal display panel 110. In other words, the common driver 108 is provided simultaneously with and by the same process as the thin film transistor TFT for switching the liquid crystal cell Clc. In this case, the thin film transistor TFT provided at the common driver 108 is made from polycrystalline silicon thin film transistor or amorphous silicon thin film transistor having a high charge mobility. For example, the common driver 108 is integrated on the other side of the substrate in such a manner as to be opposite the gate driver 104 by the CMOS process.

The common driver 108 sequentially applies a common voltage signal Vc to the common lines CL in response to common control signals CDC from the timing controller 106. This common voltage signal Vc has a polarity inverted for each vertical period 1V.

In the LCD according to the second embodiment of the present invention, even though the pixel voltage signal having a relatively low level is applied to the pixel electrode by the common voltage signal inverted during one vertical period in this manner, a liquid crystal voltage felt by the liquid crystal is equal to the prior art. Accordingly, it becomes possible to lower an output voltage level of the data drive IC in the data driver for generating the pixel voltage signal, thereby reducing power consumption. Furthermore, the pixel voltage signal output from the data driver is driven by the dot inversion system, so that it becomes possible to prevent vertical and horizontal cross talk. Moreover, the gate driver and the data driver are integrated on the substrate, so that it becomes possible to reduce a weight occupied by the TCP and the PCB, etc., thereby permitting the LCD to be made to have a thin thickness and reduce a manufacturing cost thereof.

Figure 15:
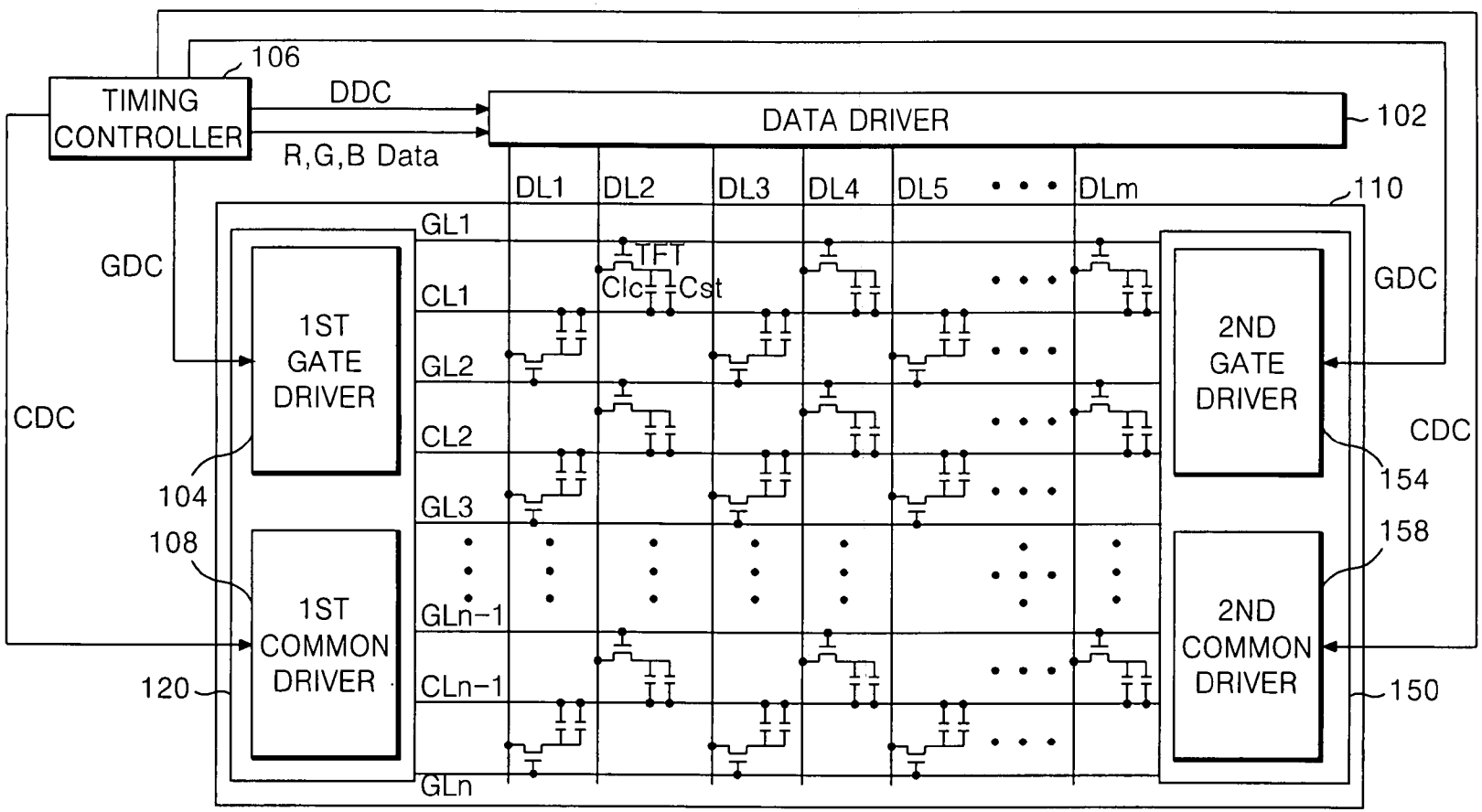
FIG. 15 is a schematic block diagram showing a configuration of a liquid crystal display according to a third embodiment of the present invention.

FIG. 15 shows a liquid crystal display (LCD) according to a third embodiment of the present invention.

Referring to FIG. 15, the LCD includes a liquid crystal display panel 110, a data driver 102 for driving data lines DL of the liquid crystal display panel 110, first and second gate drivers 104 and 154 for driving gate lines GL of the liquid crystal display panel 110, first and second common drivers 108 and 158 for driving common lines CL of the liquid crystal display panel 110, and a timing controller 106 for controlling the gate drivers 104 and 154, the common drivers 108 and 158 and the data driver 102.

The first and second gate drivers 104 and 154 are integrated on a substrate of the liquid crystal display panel 110 by the CMOS employing a polycrystalline silicon thin film transistor or amorphous silicon thin film transistor having a high charge mobility. In other words, the gate drivers 104 and 154 are provided simultaneously with and by the same process as a thin film transistor TFT for switching a liquid crystal cell Clc.

The first and second gate drivers 104 and 154 sequentially apply scanning pulses to the gate lines GL1 to GLn in response to the gate control signals GDC from the timing controller 106. Thus, the first and second gate drivers 104 and 154 allow the thin film transistors TFT connected to the gate lines GL1 to GLn to be driven for each gate line GL.

The first and second common drivers 108 and 158 are on a substrate of the liquid crystal display panel 110 by the CMOS employing a polycrystalline silicon thin film transistor or amorphous silicon thin film transistor having a high charge mobility. In other words, the first and second common drivers 108 and 158 are provided simultaneously with and by the same process as the thin film transistor TFT for switching the liquid crystal cell Clc.

The first and second common drivers 108 and 158 sequentially apply a common voltage to the common lines CL in response to common control signals CDC from the timing controller 106. This common voltage has a polarity inverted for each vertical period 1V.

Alternatively, a first signal driver 120 having the first gate driver 104 being integral to the first common driver 108 is provided at one side of the substrate, whereas a second signal driver 150 having the second gate driver 154 being integral to the second common driver 158 is provided, substantially parallel to the first signal driver 120, at the other side of the substrate. Thus, driving signals are applied from both the gate line GL and the common line CL, so that a signal delay caused by a line resistance of the signal line can be prevented. Meanwhile, an output line of each gate driver 104 and 154 and an output line of each common driver 108 and 158 are alternately provided so that adjacent output lines are formed on a different plane.

As described above, according to the present invention, the common voltage signal inverted during one vertical period is used, so that it becomes possible to lower an output voltage level of the data drive IC in the data driver for generating the pixel voltage signal, thereby reducing power consumption.

Furthermore, the pixel voltage signal output from the data driver is driven by the dot inversion system, so that it becomes possible to prevent vertical and horizontal cross talk.

Moreover, the gate driver and the data driver are integrated on the substrate, so that it becomes possible to reduce a weight occupied by the TCP and the PCB, etc., thereby permitting the LCD to be made with a thin thickness and a reduced manufacturing cost thereof.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A liquid crystal display device, comprising:

a liquid crystal display panel having thin film transistors provided on a substrate at crossings between gate lines and data lines and connected in a zigzag pattern based on the gate lines, pixel electrodes connected to the thin film transistors, common electrodes making a horizontal electric field with the pixel electrodes, and common lines connected to the common electrodes and arranged parallel to the gate lines;

a gate driver applying scanning pulse signals to the gate lines of the liquid crystal display panel;

a data driver applying pixel voltage signals to the data lines of the liquid crystal display panel; and a common driver applying alternating current common voltage signals to the common lines of the liquid crystal display panel, wherein the gate driver and the common driver are integrated on the substrate and are simultaneously formed with the thin film transistors; and wherein the alternating current common voltage signals are inverted prior to the scanning pulse signals, and wherein the common driver includes:

a first shift register for sequentially generating a first common voltage signal;

a second shift register for sequentially generating a second common voltage signal;

a level shifter for shifting swing widths of said first and second common voltage signals to a predetermined level; and a buffer for applying a voltage output from the level shifter to the gate lines.

2. The liquid crystal display device as claimed in claim 1, wherein said common voltage signals have an inverted polarity for each vertical period.

3. The liquid crystal display device as claimed in claim 2, wherein said pixel voltage signals have a polarity inverted for each vertical period and for each horizontal period.

4. The liquid crystal display device as claimed in claim 2, wherein said common voltage signals have a polarity opposite to said pixel voltage signals.

5. The liquid crystal display device as claimed in claim 1, wherein the gate driver includes:

a shift register for sequentially generating said scanning pulse signal;

a level shifter for shifting a swing width of said scanning pulse signal to a predetermined level; and a buffer for applying a voltage output from the level shifter to the gate lines.

6. The liquid crystal display device as claimed in claim 1, wherein the gate driver and the common driver are integrated on a same side of the substrate.

7. The liquid crystal display device as claimed in claim 6, further comprising:

a second gate driver and a second common driver integrated on another side of the substrate.

8. The liquid crystal display device as claimed in claim 1, wherein the gate driver and the common driver are integrated on different sides of the substrate.

9. The liquid crystal display device as claimed in claim 1, wherein the data driver is integrated on the substrate.

10. The liquid crystal display device as claimed in claim 1, wherein the first and the second common voltage signals have polarities opposite from each other.

11. The liquid crystal display device as claimed in claim 1, wherein each of the first and the second common voltage signals is shifted for each two horizontal periods.

12. The liquid crystal display device as claimed in claim 1, wherein the first and the second common voltage signals are alternatively supplied to the common line.

13. The liquid crystal display device as claimed in claim 1, wherein the first and the second common voltage signals are synchronized with the scanning pulse signal sequentially applied to the gate line to alternatively supplied to the common line.

14. The liquid crystal display device as claimed in claim 13, wherein the first and the second common voltage signals are firstly supplied to the common line than the scanning pulse signal by i horizontal period (herein, i is an integer).

* * * * *